US005233772A

United States Patent [19]

Bergeron et al.

[11] Patent Number: 5,233,772

[45] Date of Patent: Aug. 10, 1993

[54] MULTI-MESSAGE SIGN

[75] Inventors: Paul E. Bergeron, Sausalito, Calif.; David L. Wood, Hurst, Tex.

[73] Assignee: 3-Message Display Limited, Sausalito, Calif.

[21] Appl. No.: 633,370

[22] Filed: Dec. 21, 1990

[51] Int. Cl.[5] ..... G09F 11/02

[52] U.S. Cl. ..... 40/503; 40/505; 40/506

[58] Field of Search ..... 40/503, 505, 506; 74/567

[56] References Cited

U.S. PATENT DOCUMENTS

| | | | |
|---|---|---|---|
| 67,396 | 6/1901 | Heinemann | 40/505 |
| 3,383,785 | 5/1968 | Werner | 40/505 |
| 4,638,580 | 1/1987 | Giannetti et al. | 40/503 |
| 5,003,716 | 4/1991 | Dyar | 40/503 |

FOREIGN PATENT DOCUMENTS

| | | | |
|---|---|---|---|
| 2726352 | 2/1984 | Fed. Rep. of Germany . | |
| 2217502 | 10/1989 | United Kingdom | 40/505 |

*Primary Examiner*—James R. Brittain
*Assistant Examiner*—Cassandra Hope
*Attorney, Agent, or Firm*—Townsend and Townsend

[57] ABSTRACT

A sign providing for the serial display of three discreet messages is disclosed. The disclosed sign has an array of discrete vertical three sided sign elements provided with an improved sign element mounts and bearings, improved detachable face plates for the display of the three sign messages, and an improved sign element drive for simultaneous rotation of the sign element array in 120° increments for sequential display of the three discrete messages of the sign.

10 Claims, 6 Drawing Sheets

MULTI-MESSAGE SIGN

This invention relates to signs of the variety having arrays of side-to-side triangular sectioned sign elements. These signs provide for the sequential display of three discrete messages by appropriate 120° incremental and simultaneous rotation of the triangular sectioned sign elements. Each 120° incremental rotation of the triangularly sectioned side-by-side sign elements displays a single sign message across the array; three such 120° incremental rotations of the side-by-side triangular sign elements display all three sign messages which thereafter typically repeat.

More particularly, a sign is disclosed including improved mounts of the rotating triangular sectioned sign elements, improved removably attachable imprintable face elements for the display of the three discrete serial messages of the sign, and an improved drive for simultaneous 120° incremental rotation of the triangularly sectioned sign elements of the array.

BACKGROUND OF THE INVENTION

Signs for the display of three discrete messages in a serial fashion are known. In such signs, an array of triangularly sectioned sign elements having message display faces every 120° are utilized. A drive shaft extending across the array effects the desired simultaneous rotation of the array. Preferably, the sign elements display a first message for a given increment of time. Thereafter, substantial simultaneous rotation of the sign elements in an 120° increment occurs—usually by effecting rotation of the individual triangular sign elements in a cascading sequence starting at one end of the sign element array and cascading in rotation to the other end of the sign element array. As a result, three sign messages can be displayed in sequence.

Special cams have been devised to effect the rotation of such signs. A particularly advantageous cam arrangement is disclosed in Swedish Patent No. 7706713-0 issued Sep. 13, 1982 to J. E. A. Hakala. In this device it is disclosed to have rotating "butterfly" cams permanently fixed to a common shaft. These rotating butterfly cams each mesh with and rotate triangular followers on each of the discrete sign elements.

The butterfly cams are so configured that for 270° of rotation, the triangular sectioned sign elements are held in place and not driven. It is during this interval of time that one of the three serial messages of the sign is displayed from the temporarily stationary triangularly sign elements. During the remaining 90° of butterfly cam rotation, driving of the triangular sectioned sign elements occurs. This driving causes rotation of the triangular section of sign elements by increments of 120°.

Since the triangular sectioned sign elements have three message display surfaces, one of the three message displaying surfaces is rotated out of view while the serially next in order message displaying surface is rotated into view. By repeating this mechanical sequence at butterfly cams driving the triangularly sectioned sign elements of an entire array, the entirety of a sign element array displays in serial sequence its three discrete messages.

Such prior art signs have had in their application three discrete problem areas. These problem areas include the removable attachment of the message displaying faces to and from the array of rotating triangularly sectioned sign elements, and the positioning of the driving elements of the sign to the discrete triangular sign elements for the substantially simultaneous rotation and display of the sequential messages.

Posting of the message displaying faces to the rotating triangular sign elements has further not been without problems in the prior art. Specifically, the fastening of a single message displaying surface to one side of the triangular sign element has required the cooperation of at least three parts. One part is the message displaying surface itself, which surface has heretofore been constructed of a substantially non elastic material, usually metallic. A second part is the individual rotating triangular element of the sign; this rotating triangular element is also not flexible. A final part has been an elastic interface fitting between the rotating triangular sign element and message display, ridged or elastic. This interface fitting is typically conformable. It functions to conform interlocking grooves between the message display elements and rotating triangular sign element. See, for example, U.S. Pat. No. 4,528,763 issued Jul. 16, 1985 to Ahearen for Sign Having Changeable Displays.

Attachment of such message display elements is difficult. Since both the message displaying surfaces and the rotating triangularly sectioned sign elements are substantially non elastic, they must be fitted with a top to bottom snapping effecting simultaneous trapping and conforming of the elastic interface fitting.

The mounting of the butterfly cams with respect to the following triangular sign elements has constituted another major problem area. Thermal differential expansion has plagued prior art sign designs. For outdoor advertising purposes, such signs are in the order of 48 feet in length and have 144, 3⅞ inch wide individual rotating triangular sign elements. Mounting the driving butterfly cams to a common shaft and having the driving butterfly cams mesh with triangular followers at precise on center spacings has not been achieved. In the prior art, the butterfly cams—typically of made of plastic—have been fixed to a rotating metallic shaft—usually made of steel. The framing of the sign elements—defining the side-by-side spacing of the triangular sign elements of the array is fabricated from a different material—usually metallic.

As the sign encounters thermal expansions common to an outdoor advertising sign environment, the drive shaft, sign housing and sign element spacings change with differential thermal expansions. Cam spacing moves out of the original assembled alignment of the sign. Binding of the butterfly cams and triangular followers effecting the desired serial rotation of the triangular sign elements can and does result. Unnecessary energy occurs in sign element rotation. Mechanical failure of the sign element array drive follows.

Because of at least the foregoing difficulties, such triangular sign element arrays have not been widely used—despite the more efficient and interesting display of their serial messages.

DISCOVERY OF A PROBLEM

In addition to the forgoing problems, I have discovered an additional difficultly with such sign element arrays. Specifically, this difficulty relates to the differential thrust placed on the butterfly cams during their desired rotation of the triangular followers rotating the sign elements. This differential thrust can be explained relative to the complete 360° rotation of the butterfly cam to effect 120° incremental rotation of the triangular cam.

It will be remembered that during 270° of rotation of the butterfly cam, no rotation of the triangular follower will occur. During such rotation, and presuming that the triangular cam and the butterfly cam are properly aligned, no relative thrust should be experienced between the cams. This, however, is not the case during that 90° of butterfly cam rotation where the cam and follower are undergoing relative driving rotation, one with respect to the other.

During the driving 90° of butterfly cam rotation, at least two components of thrust are encountered. One component of thrust is parallel to the axis of rotation of the butterfly cam. The second component of thrust is normal to the axis of rotation of the butterfly cam. It is best to consider these components of thrust separately.

Regarding thrust parallel to the axis of butterfly cam rotation, during the first 45° of driving relative rotation on the triangular follower, the butterfly cam will be thrust away from the wing engaging the triangular follower. Stated in other terms, the butterfly cam—lacking constraint—will try and move along the driving shaft away from the triangular follower at that wing portion contacting the triangular follower.

The remaining 45° of driving rotation is different. The opposite wing of the butterfly cam will move into contact with the triangular follower. Thrust parallel to the direction of butterfly cam rotation along the driving shaft will occur; but the thrust will occur in the opposite direction from the thrust of the previous 45° of rotation.

It will be remembered that in a sign array having many such butterfly cams—each butterfly cam driving its own triangular follower—the thrust described will be cumulative. Many of the cams will be in the same state of driving rotation as their neighbors. Since all such cams have been fixed to the common driving shaft in the prior art, it will be understood that a considerable cumulative thrust from all of the cams will be present parallel to the driving shaft.

Additionally, and during the entire 90° of rotation between the driving butterfly cam and the corresponding 120° driven triangular follower, a thrust component normal to the axis of rotation of the butterfly cam is present. It is to be understood that since all butterfly cams are fixed to the common driving shaft in the prior art, it will be understood that a considerable cumulative thrust from all the cams will be present normal to the driving shaft.

The prior art references and sign products have not identified these relative thrusts. Further the prior art references and products have not been designed to accommodate these thrusts.

The reader will understand that discovery can constitute invention. In so far as the above listed discovery is novel, invention is claimed.

SUMMARY OF THE INVENTION

A sign providing for the serial display of three discreet messages is disclosed. The disclosed sign has an array of discrete vertical triangularly sectioned three sided sign elements provided with an improved sign element mounts and bearings, improved detachable face plates for the display of the three sign messages, and an improved sign element drive for simultaneous rotation of the sign element array in 120° increments for sequential display of the three discrete messages of the sign.

The improved sign element mount and bearing includes upper and lower supporting housings, which housings are of identical extruded cross section and configured for convenient attachment at the top and the bottom of a conventional sign structure of the billboard variety. Each three sided sign element of the array is mounted for rotation and supported at a stub journal on top of the bottom sign housing, and mounted and driven in rotation at rotating bearing internal of the top housing. The three sided sign elements form the display surfaces of the sign therebetween.

The upper bearing of each three sided sign elements provides vertical clearance to permit removal of the each three sided sign elements by upward sliding movement at the upper rotating bearing. This upward movement of the three sided sign element is accommodated at the top end cap and permits a stub journal at the lower end of the three sided sign element to be upwardly removed from its mount on the lower housing. As a result, the sign element can be moved forward and outward of the sign element array at its lower end for removal of that sign element from the remainder of the array.

Between the end caps, each triangular sign element includes three face plate holding sections defining irregular surfaces for being gripped by attachably removable discrete face plates. An array of imprintable elastic face plates extending the length of the sign on each of the face plate holding sections defines a single sign message; each triangular sign element at its three face plate holding sections carries three such face plates enabling the sign at its triangular sign element arrays to display serially three messages.

A triangular cam is disposed at the upper end of each triangular sign element, this triangular cam provided for effecting the desired rotation of the triangular sign element array in 120° increments for serial display of the three messages of the sign. The driving of the sign elements occurs through a driving and rotating shaft extending across the top of the sign array. The shaft defines keyed surfaces driving a series of butterfly cams. The butterfly cams slide along but rotate with the shaft at complimentary female surfaces in the butterfly cams. This connection and keying of the male and female surfaces on the drive shaft and butterfly cams provides necessary sliding and conforming relative movement along the length of the shaft between the driving and rotating shaft and butterfly cams.

These butterfly cams mate with the triangular follower on the end cap at the top of each triangular sign element. Mating of the cam and triangular follower occurs in such a manner that for 270° of rotation the butterfly cams center on the triangular follower at the top of each triangular sign element and for 90° of rotation the butterfly cams effect a 120° incremental rotation of the triangular follower on the end caps and their attached sign elements.

Paired butterfly cams are mounted on either side of and integrally formed with a central pillow block collar. This pillow block collar enables positive location of the butterfly cams with respect to the upper sign housing for all conditions of thrust occasioned by the mechanical interaction of the butterfly cams and triangular follower on the end cap in effecting sign rotation. The pillow block collars or butterfly cam bearing surface in turn rotate within capturing pillow blocks fastened through the upper housing. The pillow block collars and pillow blocks form axial thrust bearings for forces along the length of the shaft and transversed journal bearing for forces transverse of the shaft.

In the sequential operation of a typical 48 foot sign to serially display three messages, 144 panels are rotated by 72 pairs of butterfly cams keyed to a common shaft. The shaft is held relative to the sign frame by the pillow blocks and the freedom of movement of the butterfly cams on the shaft together with the confinement of the collar enables sign operation even in the presence of differential thermal expansions experienced in the outdoor advertising environment.

OTHER OBJECTS, FEATURES, AND ADVANTAGES

An object of this invention is to disclose an improved mount for the triangular sign elements of a serial message display sign. Accordingly, upper and lower housings are provided, these housing preferably having identical extruded dimension. Each triangular sign element rotates relative to the upper housing at a journal bearing and rotates relative to the lower housing at a thrust or stub bearing. The upper end cap of the triangular sign element accommodates considerable vertical movement while permitting engagement between the triangular end cap and the butterfly cam. Such vertical movement can occur to permit the lower male stub end cap on the triangular sign element to be moved upwardly and outwardly to clear the female stub of the thrust bearing on the lower housing. As a consequence, each individual triangular sign element can be individually removed from the array without disassembly of the array.

An advantage of this aspect of the invention is that both sign assembly and sign repair are facilitated. Remembering that signs are by definition placed in inaccessible locations—usually at high elevations serviced by narrow catwalks—such ease of triangular sign element assembly and removal greatly facilitates use of the sign.

An additional object of this invention is to disclose an improved face plate, each triangular member having three such face plates attached with each face plate displaying that triangular sign elements contribution to one of the three discrete sign messages. According to this aspect of the invention, the face plates are extruded from an elastic material such as polyvinyl chloride. The plastic extrusion constituting the face plates are directly imprintable on the display side and include elastically biased gripping shoulders on the opposite side. These elastically biased gripping shoulders mate with and snap into face plate retaining grooves on the triangular sign elements.

An advantage of these face plates is that they are flexible both length wise and across their narrow $3\frac{7}{8}''$ dimension. Flexibility in the narrow dimension enables the snapping on and snapping off of the array of face plates to change the messages. The flexibility in the longitudinal dimension enables the face plates to be serially rolled onto or peeled off from the triangular sign elements. As a result, attachment of the face plates is vastly improved over the rigid three piece attachment face plates of the prior art.

An additional object of this invention is to disclose an improved drive for effecting the 120° incremental rotation of the triangular sign elements at the driving triangular follower from a common shaft rotating the driving butterfly cams of the prior art. According to this aspect of the invention, the driving shaft is fabricated with an irregular male drive surface—this surface provided by a shaft section which is preferably hexagonal. The butterfly cams are each fabricated with a mating irregular female driving surface—these surfaces provided by a female aperture preferably having a female surface complimentary to the male surface of the shaft. Each butterfly cam has an adjacent bearing fixed and integrally fastened to it—it is preferred that two butterfly cams be fixed on opposite sides of a single collar. A pillow block fits in circumscribing relationship around the bearing and consequently centers butterfly cams connected with the pillow block. As a result, a drive for such a sign is disclosed which centers the butterfly cam and its driving shaft with respect to the triangular follower and the triangular sign element during all possible thermal excursions utilized by the sign.

An advantage of the pillow block collar and butterfly bearing is that the thrust of the cams is localized at the pillow block collar and its constraining pillow block. Cumulative displacement responsive to cumulative thrust along the length of the shaft does not occur.

An advantage of the disclosed drive is that the drive train wear is reduced. Further, incidents of jamming of the sign elements during operation are reduced. A drive structure having low maintenance requirement operable in all known outdoor advertising climates is disclosed.

DESCRIPTION OF THE PREFERRED EMBODIMENT

Figure 1A:
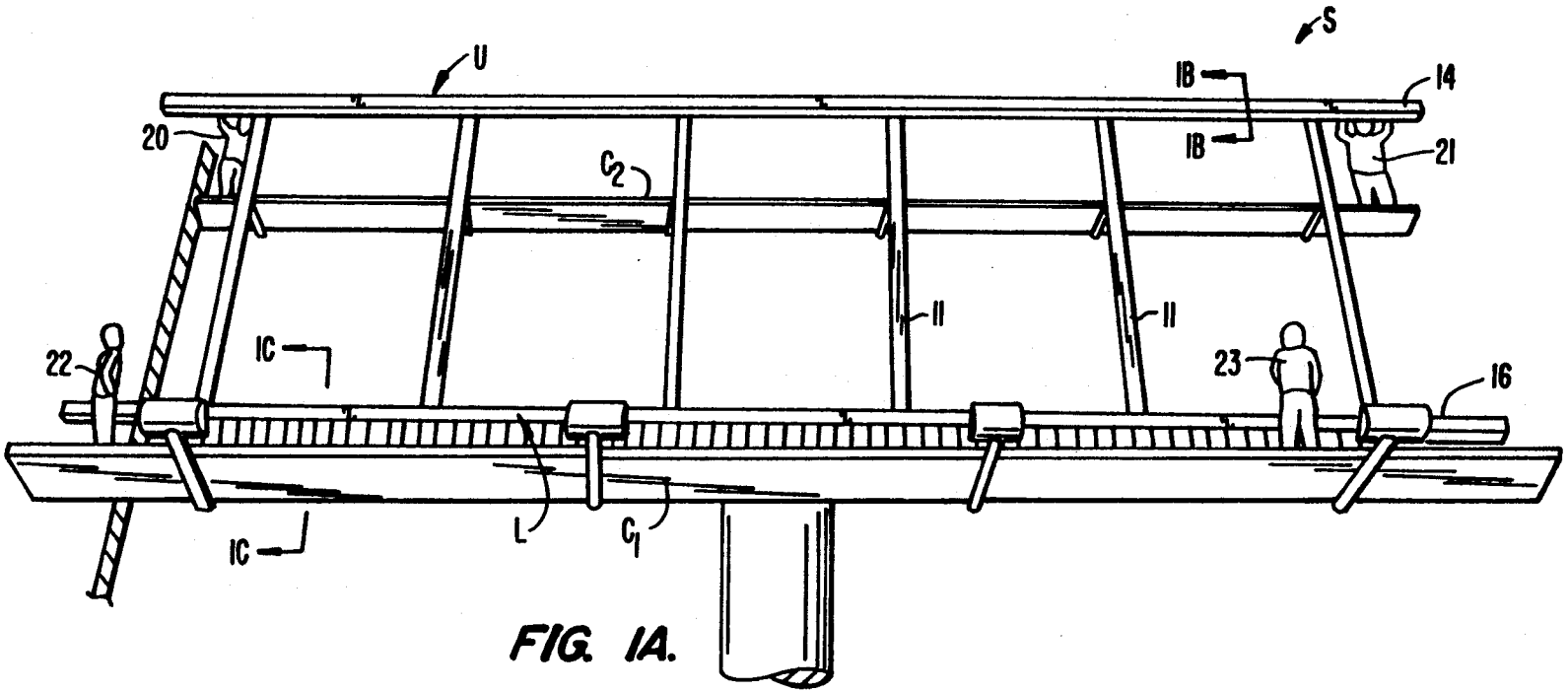
FIG. 1A is a perspective view of a sign according to this invention illustrating a typical prior art sign support structure with the upper housing and drive assembly about to be attached to conventional upper housing support stringers along the prior art sign support and the lower housing already in place.
Figure 1D:
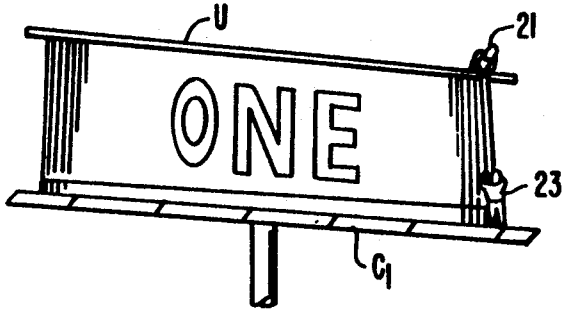
FIG. 1D is a perspective view of the sign similar to FIG. 1A with the sign elements completely assembled except for the placement of the last triangular sign element, this element being shown in the process of being moved into place.

Referring to FIG. 1A, a standard sign support is illustrated. The sign support is of the type that includes a lower catwalk C1 at the front portion of the sign and an upper catwalk C2 at the top rear portion of the sign. Signs S includes various vertical support members 11 and horizontal stringers 14 and 16. It is to these respective horizontal stringers 14, 16 that upper housing U at stringer 14 and lower housing L at lower stringer 16 are mounted. In the illustration herein, workmen 20, 21 are shown installing upper housing U. Workmen 22, 23 are shown installing lower housing L. The purpose, of course, is to have a complete sign such as that illustrated in FIG. 1D.

Figure 1B:
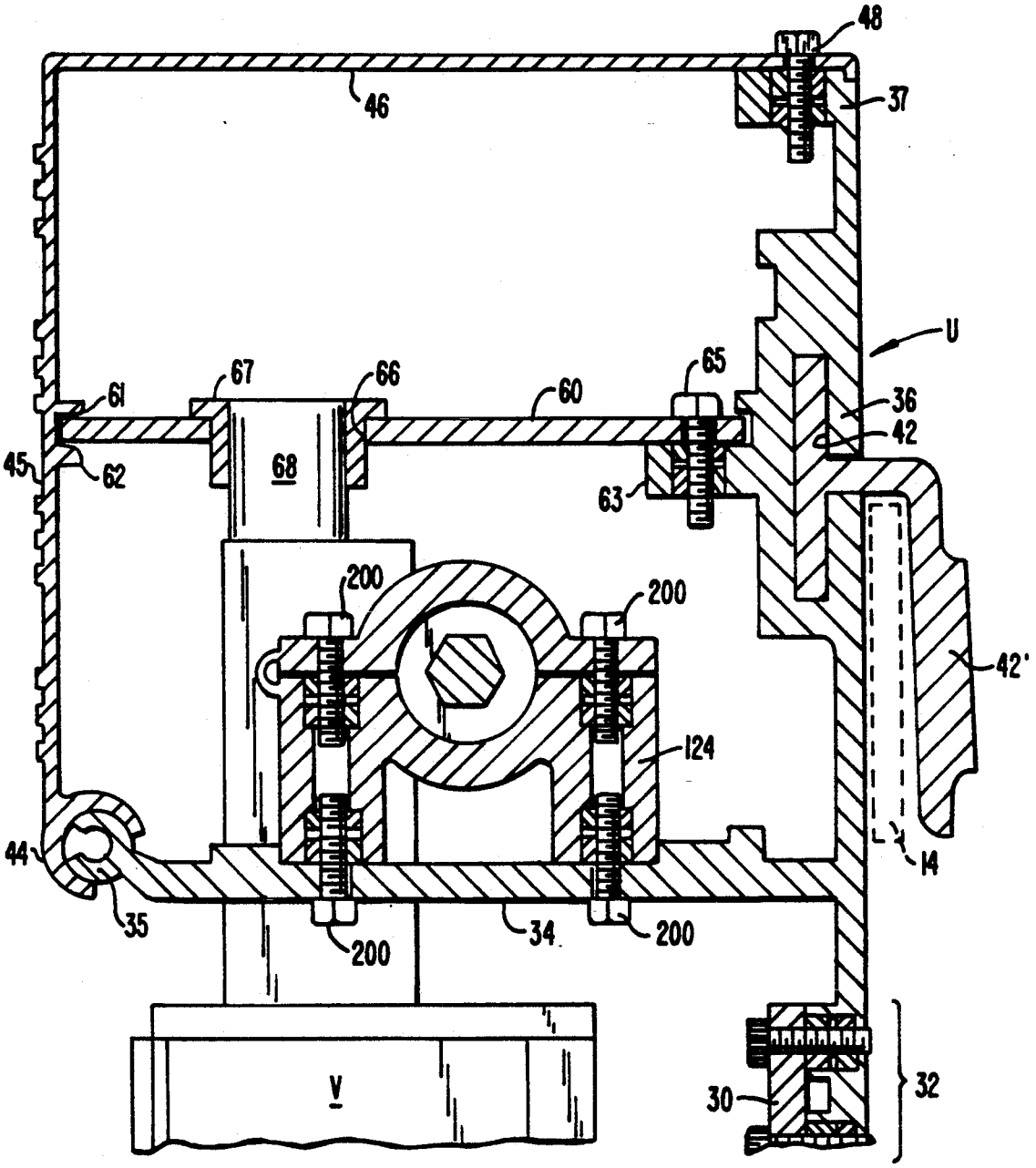
FIG. 1B is a side elevation section taken along lines 1B—1B of FIG. 1A illustrating the construction of the overlying upper housing and drive assembly.
Figure 1C:
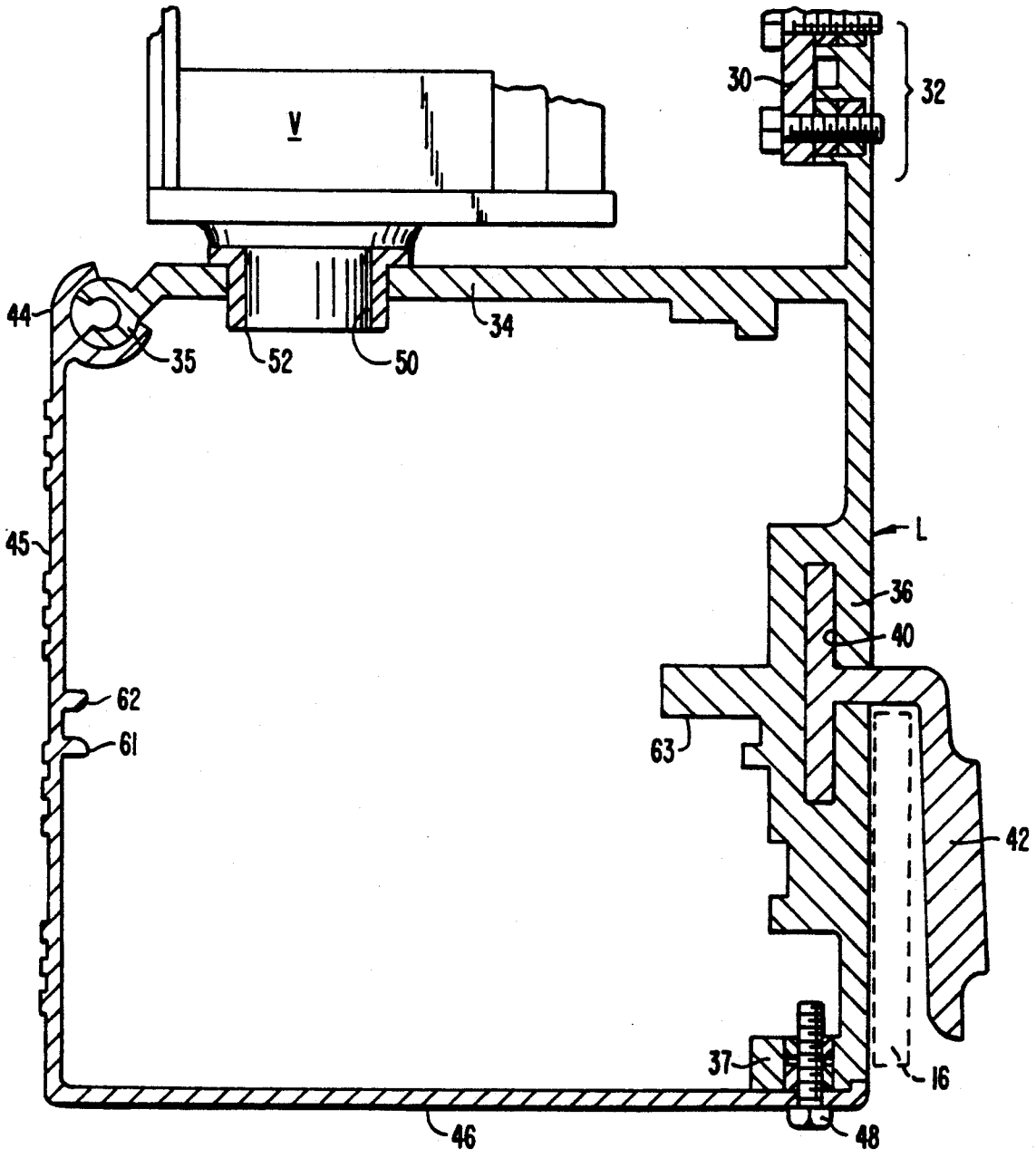
FIG. 1C is a side elevation section taken along lines 1C—1C of FIG. 1A illustrating the construction of the lower housing and support conventional lower stringers along the prior art sign support.

Referring briefly to FIG. 1B, a cross section of the upper housing U is illustrated. Referring to FIG. 1C, a cross section of the lower housing L is illustrated. It is necessary for these two respective housing members to be held in fixed spaced-apart relationship. Accordingly, straps 30 fasten on strap brackets 32 on the upper housing U and to strap brackets 32 on the lower housing L.

Analyzing further just the construction of the exterior of both the upper housing U and the lower housing L, the reader will understand that the construction of the housing member is symmetrical. Stated in other terms, by using a single extrusion molding, the housing member and its hinged attached cover are precisely identical in both upper housing U and lower housing L.

Referring to FIG. 1C, the construction of the lower housing member will be described. Referring to FIG. 1C, horizontal support member 34, having a hinge pin extrusion 35, is formed. A vertical support member 36 having a hinge cover fastening portion 37 is illustrated. The vertical member 36 includes a T-shaped indentation 40. Into T-shaped indentation 40 fastens a stringer clip 42. Clip 42 fastens about lower stringer 16 and is the member which fastens the lower housing to the sign support S (see FIG. 1A).

The housing cover is likewise easy to understand. It includes a female hinge portion 44, a vertical cover portion 45 and a lower cover portion 46. Cover portion 46 bolts with bolts 48 into the vertical member 36 at hinge cover fastening portion 37.

It will be seen that upper horizontal support member 34 of the lower housing L includes a bore 50. Bore 50 accommodates a bushing 52 on the bottom of the vane member V. Vane member V will be described in more detail hereafter with respect to FIG. 2A and 2B.

Returning to FIG. 1B, it will be seen that similar portions of the housing member there illustrated bear similar numeral notations. It will be seen that the housing cover 45, 46 faces upwardly in FIG. 1B. This same housing cover faces downwardly in FIG. 1C.

It will be appreciated that upper housing U has a function that lower housing L does not have. Specifically, it is the purpose of upper housing L to contain the butterfly cams. This being the case, the addition of the appreciable extra mechanism interior of upper housing U will be understood with.

Additionally, it will be appreciated FIG. 1B that the stringer clip 42' threading into the T-shaped aperture 40 is reversed from its disposition illustrated with respect to FIG. 1C. It can therefore be appreciated that this makes possible the support of upper housing of stringer 14.

Upper housing U includes a horizontal transverse plate 60 spanning the interior dimension. Plate 60 rests on cover 45, 46 at protruding rib 62 and on interior plate 63 to which bolting occurs at bolts 65. Plate 60 is captured between ribs 61, 62. It is the function of plate 60 to support at an aperture 66 a bushing 67 which bushing 67 supports the upper bearings 68 of vane V.

Having set forth this much detail, attention can now be directed to vane V with respect to FIG. 2.

Referring to FIG. 2, there is illustrated a vane V. Vane V is a triangularly shaped member held vertically aligned. Vane V has respective vertical sides 70, 71, and 72, all with their respective planes at 120° increments from one another with respect of the vertical axis of vane V.

At its lower end, adjacent the lower housing L, vane V is provided with a lower cover 74 and a protruding journal 68. At its upper end, adjacent the upper housing U, vane V is provided with an upper cover 76. Protruding from upper cover 76 is a triangular follower 78 and protruding journal 68.

Figure 2B:
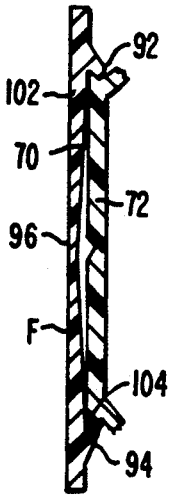
FIG. 2B is a cross sectional view of the engagement of a face plate to the side of a rotating vane.
Figure 2A:
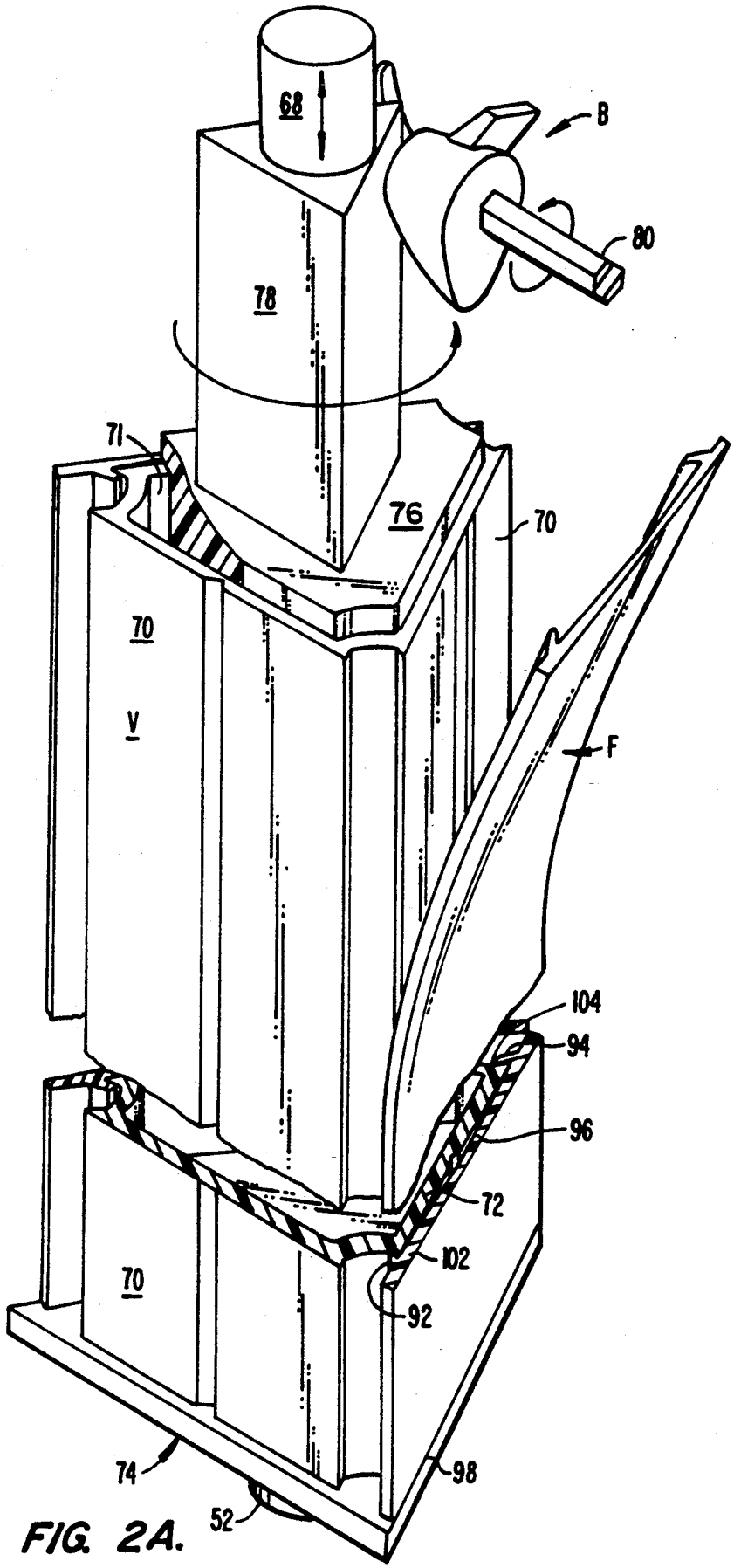
FIG. 2A is a perspective view of a triangular sign element shown with middle portions broken away, the triangular sign element being shown as one of the three removably attachable sign face elements is fitted into place by being impressed to the surface of the triangular sign element.

Schematically illustrated at the top of FIG. 2A is a butterfly cam B driven by hexagonal shaft 80. For purposes of the present discussion, it is sufficient to understand that butterfly cam B in 360° of rotation will affect incremental rotation of vane V. Specifically, and when 90° of active rotation of butterfly cam B occurs, vane V is rotated at triangular follower 78 an increment of 120°. As has been previously explained, the rotation of triangular follower 78 will be intermittent. Such rotation will occur during one part of a four-part rotational duty cycle. During the remaining three parts of the four-part rotational duty cycle, vane V will be essentially stationary allowing its message to be displayed.

Referring still further to FIG. 2A and 2B, the construction of the removably detachable face plate F can be seen. Specifically, face plate F is fabricated from a semi-rigid, but flexible, plastic preferably a polyvinyl chloride. It includes paired protruding ribs 92, 94 extending from its major surface 96. Typically, face plate F is forced over respective protruding corners 102, 104 at the side edges of vertical sides 70, 71, 72. Thus, the semi-rigid face plate F can readily be installed and readily be removed from the vane structure V with the flexing and peeling motion indicated at the top of vertical face 72 in FIG. 2A. A sectional detail of the face is shown in FIG. 2B.

It will be further seen that the bottom end cap 74 provides a supporting surface for the bottom of the face plate at 98. The top end cap 76 does not protrude over the edge of the vane.

Figure 3:
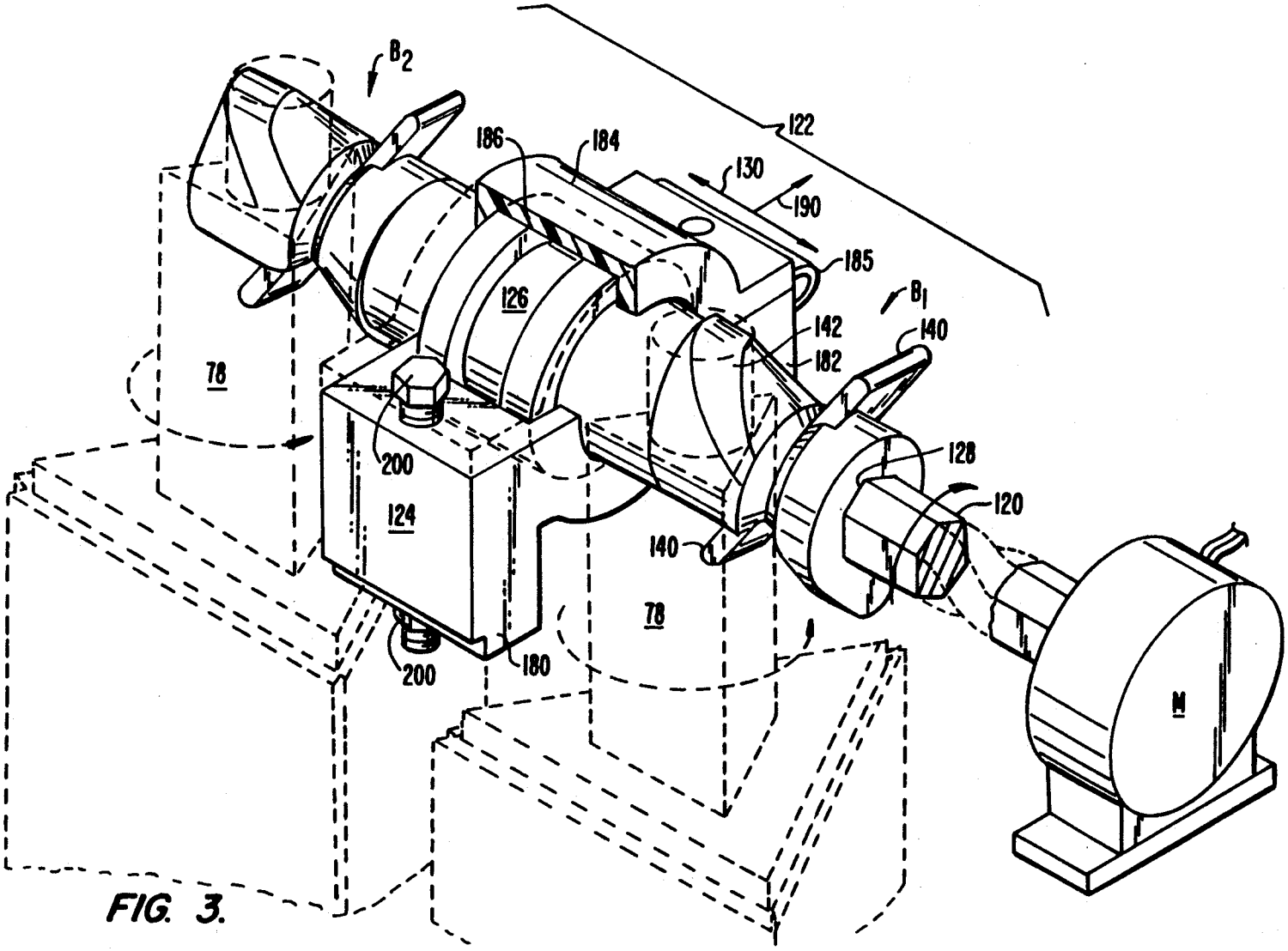
FIG. 3 is a perspective view of a sign drive mechanism at the upper portion of the sign showing the preferred arrangement of two triangular sign elements being driven at attached triangular cams by paired butterfly cams housed by a common pillow block.

Having discussed the triangular vane V and its three removably detachable sides F, each with their own message increment on the outside, a detailed examination of the driving mechanism can now be set forth with respect to FIG. 3.

First, it is important for the reader to remember that, in FIG. 3, the drive mechanism is supported on horizontal support member 34. For purposes of clearly understanding the invention, the horizontal support member 34 and housing member U of FIG. 1B is omitted. Only the drive mechanism is shown.

The drive mechanism of FIG. 3 includes a driving shaft 120, a cam and collar combination 122, and a collar block assembly 124.

Shaft 120 is driven by a motor M, here schematically illustrated. The shaft extends the entire length of the upper housing U. It is periodically supported at cam and collar combinations 122 by pillow block assemblies 124 from horizontal support member 34 of the upper housing U.

The cam and collar combination includes a first butterfly cam B1, a second butterfly cam B2, and a collar 126 therebetween. Respective butterfly cams B1 and B2 are integrally formed with respect to the collar 126; in combination they form a unitary assembly.

Cam and collar combination 122 has concentric hexagonal aperture 128. Aperture 128 allows hexagonal shaft 120 to be threaded through aperture 128. This construction provides two separate features.

First, the cam and collar combination is given the ability to move lengthwise up shaft 120, along the direction of arrow 130. Secondly, and because of the hexagonal configuration, the rotation of shaft 120 imparts similar rotation to the cam and collar combination.

The function of the respective butterfly cams B1, B2, in rotating the illustrated triangular followers (similar to 78) is set forth elsewhere in Swedish Patent No. 7706713-0, issued Sep. 13, 1982 to J. E. A. Hakala. The construction of butterfly cams B1, B2 and cam followers 78 is similar; the end cap construction shown here is not included in the Swedish Patent. Its construction will not be further detailed herein, except to point out that it includes a major turning surface 140, a minor turning surface 142. It will be seen further in the cam collar combination here illustrated that I choose to have two butterfly cams B1, B2 for each collar 126. The reader will appreciate that it may do just as well to include as few as one cam B1 or a multiple of cams beyond the two illustrated. I have shown my preferred construction with respect to FIG. 3.

The construction of pillow block 124 is easy to understand. It includes lower block members 180, 182. Typically, the block members are formed of plastic and include an overlying cover member 184. Member 184 attaches to the lower member 182 by means of a hinge 185 and containment bolts 200 (see FIGS. 1B and 3).

It is the function of the pillow block 124 to define a female cavity 186 which captures collar 126. Accordingly, both upper member 184 and lower members 180, 182 define a collar capturing aperture which collar capturing aperture securely braces collar 126 in any motion.

The type of motion that occurs can be understood. Typically, and as rotation occurs, butterfly cams B1, B2 cause two types of motion. That motion will be along arrow 130 and occur in a first direction (towards motor M) and thereafter in a second direction (away from motor M). In such motion, collar 126 as captured within pillow block 124 will resist the tendency of the cam and collar combination to move responsive to these forces.

Further, and during the motion of the cam, collar 126 will experience a force urging the collar in the direction of vector 190. Again, the pillow block 124, in capturing collar 126, will resist this motion.

It will be appreciated that with respect to the motions in which movement can occur, the reader will appreciate that they are cumulative. That is to say, the illustrated completed sign of FIG. 1D includes 144 such vanes with 72 cam and collar combinations such as that illustrated with respect to FIG. 3. It will be understood that, without the support here illustrated in the form of the collars 126 and the pillow blocks 124 that prevention of the flexure of hexagonal shaft 120 could not as a practical matter occur over the full length of the sign.

Referring to FIG. 3, the reader will understand that shaft 120 is typically twisted 90° as extends from one end of the illustrated sign to the other end of the illustrated sign. That is to say, as the shaft extends from workman 20 to workman 21 in upper housing U across the entire width of the sign, a 90° overall twist occurs in shaft 120. This twist enables the display to have an attractive cascading rotation.

Figure 4:
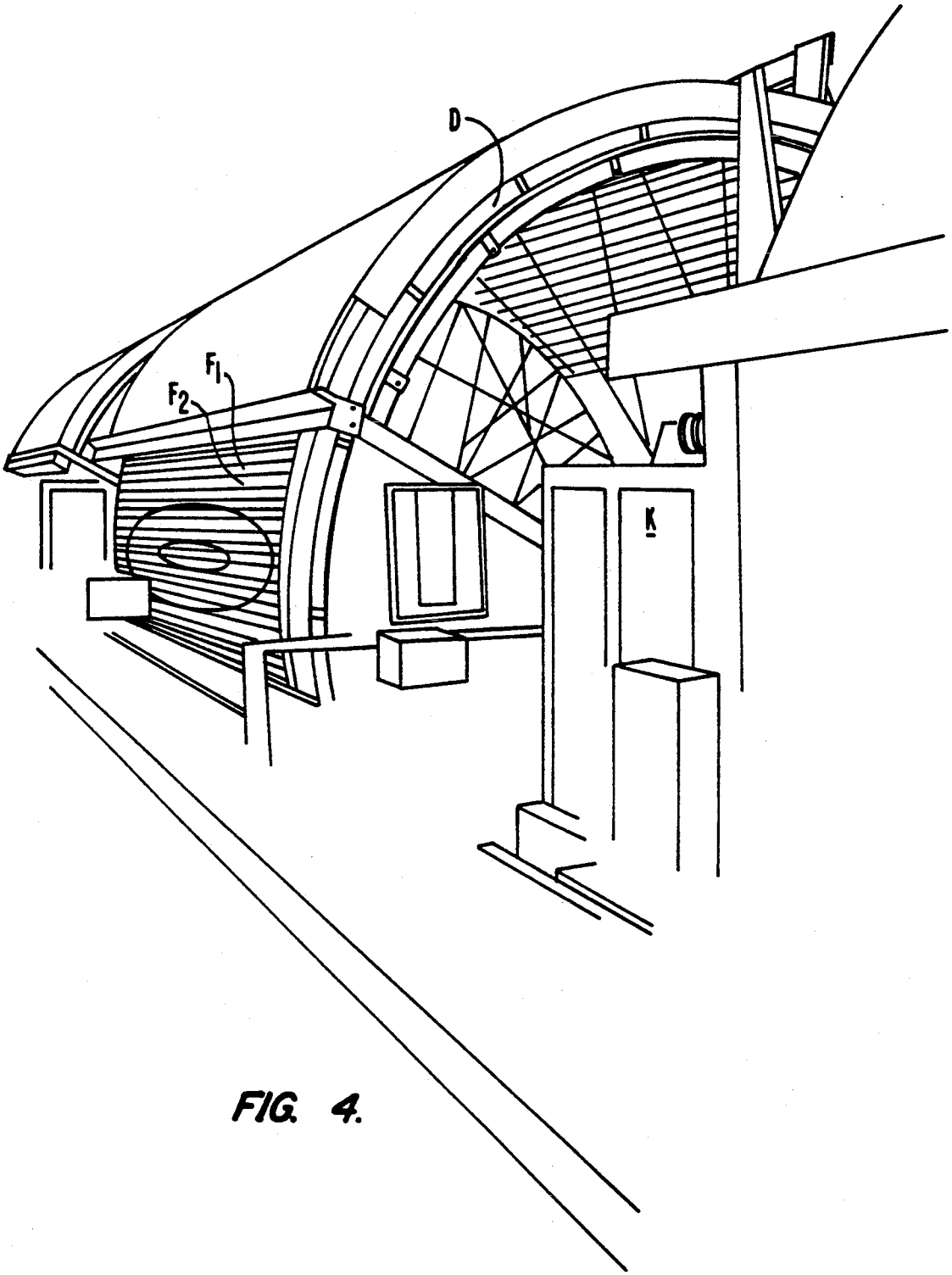
FIG. 4 illustrates how the removably attachable sign face elements may be imprinted with images.

Finally, with respect to FIG. 4, it will be appreciated that the flexible, removably detachable face plates F are capable of being imprinted directly with their respective messages. Accordingly, there is illustrated a rotating drum D having the vertical, removably detachable elements F1, F2 attached thereto. These elements are painted under computer controls by a computer K in a method that is well known by those having skill in the art. What is important to realize that the surface of the removably detachable face plates F forms a surface onto which imprinting of the sign indicia can directly occur.

What is claimed is:

1. A sign for the serial display in a repeating format of three discrete messages, said sign comprising in combination:

an array of side-by-side triangular sign elements, each of said triangular elements having three display surfaces for permitting said array to display a discrete message when said array of triangular sign elements is simultaneously rotated to present the display surfaces for a single message;

a first housing for the side-by-side rotating support of one end of said sign elements;

a second housing for the side-by-side rotating support of the other end of said sign elements whereby said triangular sign elements are rotated in side-by-side relation between said housings to permit sequential serial display of said three sign messages;

a triangular follower on one end of all said triangular sign elements, said follower for effecting 120° incremental rotation of said sign elements;

at least one butterfly cam for driving each said triangular follower of said sign elements in 120° increments upon rotation of said butterfly cam, said butterfly cam defining a first drive surface for causing the rotation of said butterfly cam from a drive shaft;

a drive shaft defining a complementary second drive surface for keying to said butterfly cam at said first drive surface for rotating said butterfly cam with said drive shaft;

said first drive surface on said butterfly cam and said second drive surface on said drive shaft cooperatively configured for permitting said butterfly cam to move along said shaft during said rotation whereby said butterfly cam undergoes relative movement with respect to said shaft during driving rotation from said drive shaft during thermal differential expansion of said shaft and sign;

bearing means fixedly attached to a support for centering and supporting said butterfly cam with respect to said triangular sign element for maintaining said butterfly cam centered to said triangular sign element;

whereby a centered relationship is maintained between said triangular followers and said butterfly cams.

2. The invention of claim 1 and wherein said bearing means for centering includes a collar attached to said butterfly cam and a collar receiving female cavity attached to said sign, said collar receiving female cavity permitting rotation of said collar within said recess.

3. The invention of claim 1 and wherein said triangular sign elements are vertically aligned; and, said triangular followers and said butterfly cams are at the upper end of said triangular sign elements.

4. The invention of claim 1 wherein said drive shaft defining said complementary surface for keying to said butterfly cam is twisted.

5. In a sign for the serial display in a repeating format of three discrete messages, said sign including:

an array of side-by-side triangular sign elements, each of said triangular elements having three display surfaces, each display surface for permitting said array to display a discrete message when said array of triangular sign elements is simultaneously rotated to present the display surfaces for a single message;

a first housing for the side-by-side rotating support of one end of said sign elements;

a second housing for the side-by-side rotating support of the other end of said sign elements whereby said triangular sign elements are rotated in side-by-side relation between said housings to permit sequential serial display of said three sign messages;

a triangular follower on one end of all said triangular sign elements, said cam for effecting 120° incremental rotation of said sign elements;

at least one butterfly cam for driving each said triangular follower of said sign elements in 120° increments upon rotation of said butterfly cam; the improvement to said butterfly cam and drive shaft comprising:

said butterfly cam defining a first drive surface for causing the rotation of said butterfly cam from a drive shaft;

a drive shaft defining a complementary second drive surface for keying said butterfly cam for rotation responsive to rotation of said shaft;

said first drive surface for causing the rotation of said butterfly cam and said second drive surface of said drive shaft cooperatively configured for permitting said butterfly cam to move along said shaft during driving of said triangular follower whereby said butterfly cam undergoes relative movement with respect to said shaft during driving rotation of said triangular sign element through said triangular follower;

bearing means fixedly attached to a support for centering and supporting said butterfly cam with respect to said triangular sign element for maintaining said butterfly cam centered to said triangular sign element.

6. The invention of claim 5 and wherein each said bearing means has first and second butterfly cams affixed thereto.

7. The invention of claim 5 and wherein said triangular sign elements are vertically aligned; and, said triangular follower and said butterfly cams are at the upper end of said triangular sign elements.

8. The invention of claim 5 and wherein said drive shaft defining said complementary surface for keying to said butterfly cam is fitted concentrically to said butterfly cam.

9. IN a sign for the serial display in a repeating format of three discrete messages, said sign including:

an array of side-by-side triangular sign elements, each of said triangular elements having three display surfaces, each display surface for permitting said array to display a discrete message when said array of triangular sign elements is simultaneously rotated to present the display surfaces for a single message;

a first housing for the side-by-side rotating support of one end of said sign elements;

a second housing for the side-by-side rotating support of the other end of said sign elements whereby said triangular sign elements are rotated in side-by-side relation between said housing to permit sequential serial display of said three sign messages;

a triangular follower on one end of all said triangular sign elements, said triangular follower for effecting 120° incremental rotation of said sign elements;

a butterfly cam for driving each said triangular follower of said sign elements in 120° increments upon rotation of said butterfly cam;

a drive shaft for driving said butterfly cams to effect the simultaneous rotation of said butterfly cams;

bearing means fixedly attached to a support for centering and supporting said butterfly cams with respect to said triangular sign elements for maintaining said butterfly cams centered to said triangular sign elements; the improvement to said first housing and said triangular follower comprising in combination;

said first housing defining a vertically elongate bearing for permitting movement of said triangular sign elements towards and into said housings;

said second housing defining first a short bearing for permitting said triangular sign elements to be moved free of support on said second housing and moved outwardly of said array for removal of triangular sign element from said array of said sign; and, said triangular follower being elongate with respect to said butterfly cam to permit longitudinal relative movement between said cams for movement of said triangular sign elements with respect to said housings.

10. The invention of claim 9 and wherein said triangular sign elements are vertically aligned; and, said triangular followers and said butterfly cams are at the upper end of said triangular sign elements.

* * * * *